US008783353B2

(12) United States Patent
Saheta et al.

(10) Patent No.: US 8,783,353 B2
(45) Date of Patent: Jul. 22, 2014

(54) INCREASED ENERGY IMPACT TOOL

(75) Inventors: Vishal Saheta, Houston, TX (US); Arley G. Lee, Katy, TX (US)

(73) Assignee: Smith International, Inc., Houston, TX (US)

( * ) Notice: Subject to any disclaimer, the term of this patent is extended or adjusted under 35 U.S.C. 154(b) by 388 days.

(21) Appl. No.: 13/037,653

(22) Filed: Mar. 1, 2011

(65) Prior Publication Data

US 2011/0209918 A1 Sep. 1, 2011

Related U.S. Application Data

(60) Provisional application No. 61/309,250, filed on Mar. 1, 2010.

(51) Int. Cl.
*E21B 4/14* (2006.01)
*E21B 31/113* (2006.01)

(52) U.S. Cl.
USPC ..... 166/301; 166/178; 175/297; 175/299

(58) Field of Classification Search
USPC ..... 166/301, 178; 175/293, 296, 297, 299
See application file for complete search history.

(56) References Cited

U.S. PATENT DOCUMENTS

| | | | | |
|---|---|---|---|---|
| 4,076,086 | A * | 2/1978 | Evans | 175/297 |
| 4,226,289 | A * | 10/1980 | Webb et al. | 175/297 |
| 4,545,444 | A * | 10/1985 | Webb et al. | 175/296 |
| 4,865,125 | A | 9/1989 | De Cuir | |
| 5,033,557 | A | 7/1991 | Askew | |
| 5,217,070 | A | 6/1993 | Anderson | |
| 5,595,244 | A | 1/1997 | Roberts | |
| 5,906,239 | A | 5/1999 | Oettli | |
| 6,453,997 | B1 | 9/2002 | McNeilly et al. | |
| 6,725,932 | B2 | 4/2004 | Taylor et al. | |
| 6,988,551 | B2 | 1/2006 | Evans | |
| 7,066,263 | B1 | 6/2006 | Mouton | |
| 7,290,604 | B2 | 11/2007 | Evans | |
| 7,311,149 | B2 | 12/2007 | Evans | |
| 7,451,834 | B2 | 11/2008 | Shears et al. | |
| 2006/0054322 | A1 * | 3/2006 | Rose | 166/301 |
| 2006/0169456 | A1 * | 8/2006 | Evans | 166/301 |

FOREIGN PATENT DOCUMENTS

| | | | |
|---|---|---|---|
| EP | 0314130 | A1 | 5/1989 |
| EP | 0456305 | A2 | 11/1991 |

OTHER PUBLICATIONS

International Search Report and Written Opinion issued in corresponding International Application No. PCT/US2011/026658; Dated Oct. 20, 2011 (6 pages).

* cited by examiner

*Primary Examiner* — Cathleen Hutchins
(74) *Attorney, Agent, or Firm* — Osha Liang LLP

(57) ABSTRACT

A downhole jarring tool includes a mandrel having a small diameter portion and a large diameter portion, a detent cylinder sealingly disposed around the mandrel forming an enclosure, a divider disposed in the enclosure between the mandrel and the detent cylinder, wherein the divider partitions the enclosure into a storage chamber and a metering chamber, and a metering system disposed around the mandrel. A method of applying an impact force using a downhole jarring tool includes moving a mandrel with respect to a detent cylinder by applying an axial force, positioning the mandrel such that a metering system disposed on the mandrel enters a reduced diameter portion of the detent cylinder, transmitting energy to an energy storing component disposed inside the detent cylinder, metering a fluid through the metering system, and accelerating the mandrel with respect to the detent cylinder.

22 Claims, 10 Drawing Sheets

INCREASED ENERGY IMPACT TOOL

BACKGROUND OF INVENTION

1. Field of the Invention

Embodiments disclosed here generally relate to a downhole jarring tool. More specifically, embodiments disclosed herein generally relate to a downhole jarring tool configured to provide an increased impact.

2. Background Art

In the drilling of wells, a drill bit is used to dig many thousands of feet into the earth's crust. FIG. 1A shows one example of a conventional drilling system for drilling an earth formation. The drilling system includes a drilling rig 100 used to turn a drilling tool assembly which extends downward into a wellbore 102. The drilling tool assembly includes a bottom-hole assembly (BHA) 106 disposed on a lower portion of a drill string 104. Looking to FIG. 1B, BHA 106 may include a drill bit 208, a bit sub 210, stabilizers 216, a drill collar 218, and a jarring tool 220. The BHA may also include measurement-while-drilling and/or logging-while-drilling equipment 212, a mud motor 214, and a jar impact amplifier or a jar accelerator 222.

During a drilling operation, one or more of the drilling tool assembly components may become stuck in the wellbore 102. The jarring tool 220 may be used to apply an impact load to the stuck component so that the stuck component may be dislodged and drilling operations may continue. Actuating jarring tool 220 to apply an upward jar includes applying a tensile force to drill string 104. Drill string 104 is held in place by the stuck component of the drilling tool assembly and the applied tensile force stretches drill string 104. As a result, energy is stored in drill string 104 in the form of material strain. Release of the applied tensile force transmits the energy stored in the stretched drill string 104 to the stuck component, thereby loosening the stuck component.

Looking to FIG. 2, a cross-sectional view of an example of a jarring tool 220 known in the prior art is shown. Jarring tool 220 includes an inner tubular 302 configured to connect with a drill string (not shown) and an outer tubular 304 configured to connect to a stuck object (not shown). Outer tubular 304 has an inner diameter 306 and a restriction 308 having a reduced inner diameter. A cavity 312 formed between inner tubular 302 and outer tubular 304 is filled with incompressible hydraulic fluid. As the drill string, and thus the inner tubular 302, are pulled upward, a sleeve assembly 310 disposed on inner tubular 302 and having an outer diameter approximately equal to the inner diameter of restriction 308 enters restriction 308. Movement of the incompressible hydraulic fluid around sleeve assembly 310 is thereby limited which provides for a build up of fluid pressure inside cavity 312. When sleeve assembly 310 exits restriction 308 as the drill string is moved upward into an upper portion of cavity 312 having inner diameter 306, high pressure fluid passes over sleeve assembly 310, thereby relieving the pressure differential and releasing energy stored by the high pressure fluid. The released energy accelerates sleeve assembly 310 and inner tubular 302 upward until two opposing shoulders 314, 316 disposed on inner and outer tubulars 302, 304, respectively, collide and provide an upward impact force which may dislodge the stuck object.

Alternatively, jarring tool 220 may be used to provide a downward jar by applying a compressive force to the drill string and inner tubular 302, thereby forcing sleeve assembly 310 downward through restriction 308. Fluid pressure build up occurs in a lower portion of cavity 312 and, when sleeve assembly 310 exits through a lower end of restriction 308, fluid pressure is relieved which releases stored energy, such that sleeve assembly 310 and inner tubular 302 are accelerated downward with respect to outer tubular 304. Two opposing shoulders 318, 320 disposed on inner and outer tubulars 302, 304, respectively, collide and provide a downward impact force to the stuck object.

To increase the amount of impact applied to the stuck component, accelerator tools known in the art may be used in combination with jarring tools. Accelerator tools allow additional energy to be stored that may be released when the jarring tool is actuated. The additional energy may increase the impact force transmitted to the stuck component which may help to dislodge the stuck component.

Accordingly, there exists a continuing need for improved jarring tools.

SUMMARY OF INVENTION

In one aspect, embodiments disclosed herein relate to a downhole jarring tool including a mandrel having a small diameter portion and a large diameter portion, a detent cylinder sealingly disposed around the mandrel, forming an enclosure, a divider disposed in the enclosure between the mandrel and the detent cylinder, wherein the divider partitions the enclosure into a storage chamber and a metering chamber, and a metering system disposed around the mandrel.

In another aspect, embodiments disclosed herein relate to a method of applying an impact force using a downhole jarring tool, the method including moving a mandrel with respect to a detent cylinder by applying an axial force, positioning the mandrel such that a metering system disposed on the mandrel enters a reduced diameter portion of the detent cylinder, transmitting energy to an energy storing component disposed inside the detent cylinder, metering a fluid through the metering system, and accelerating the mandrel with respect to the detent cylinder, wherein the accelerating the mandrel comprises releasing energy stored in the energy storing component.

Other aspects and advantages of the invention will be apparent from the following description and the appended claims.

DETAILED DESCRIPTION

In one aspect, embodiments disclosed herein relate to a downhole jarring tool. More specifically, embodiments disclosed herein generally relate to a downhole jarring tool configured to provide an increased impact.

Figure 1B:
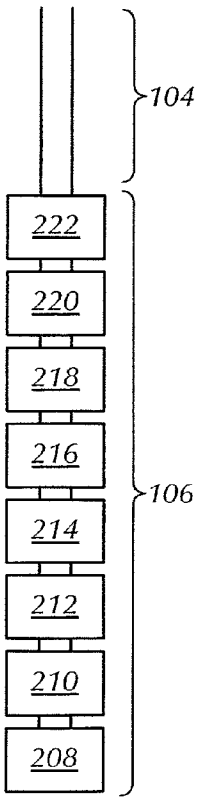
FIG. 1B (Prior Art)
FIG. 1B is a diagram of a prior art bottom hole assembly.
Figure 1A:
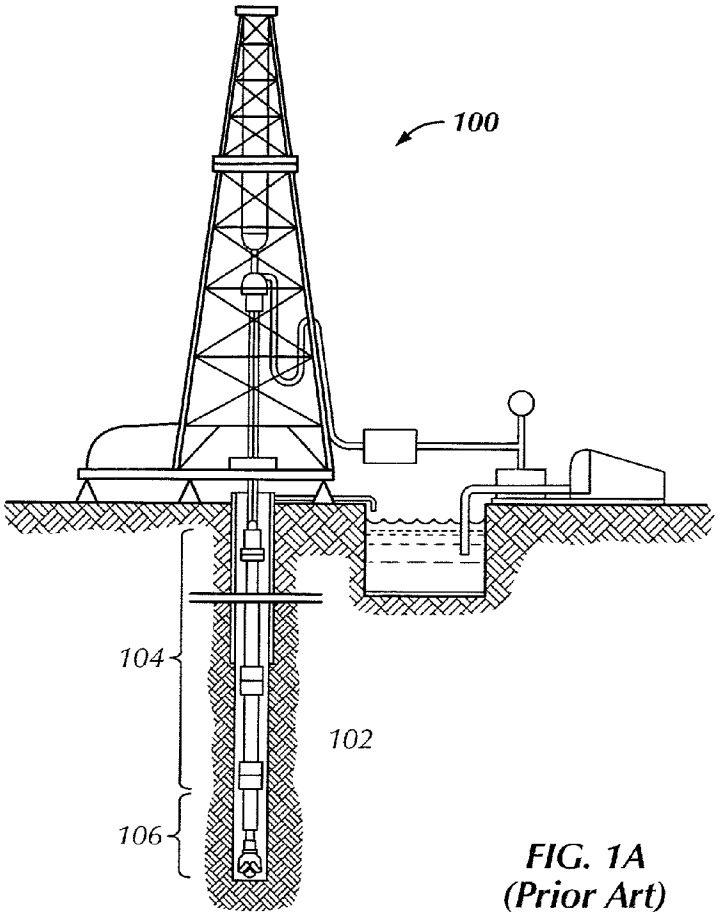
FIG. 1A (Prior Art)
FIG. 1A is a prior art drilling system.
Figure 2:
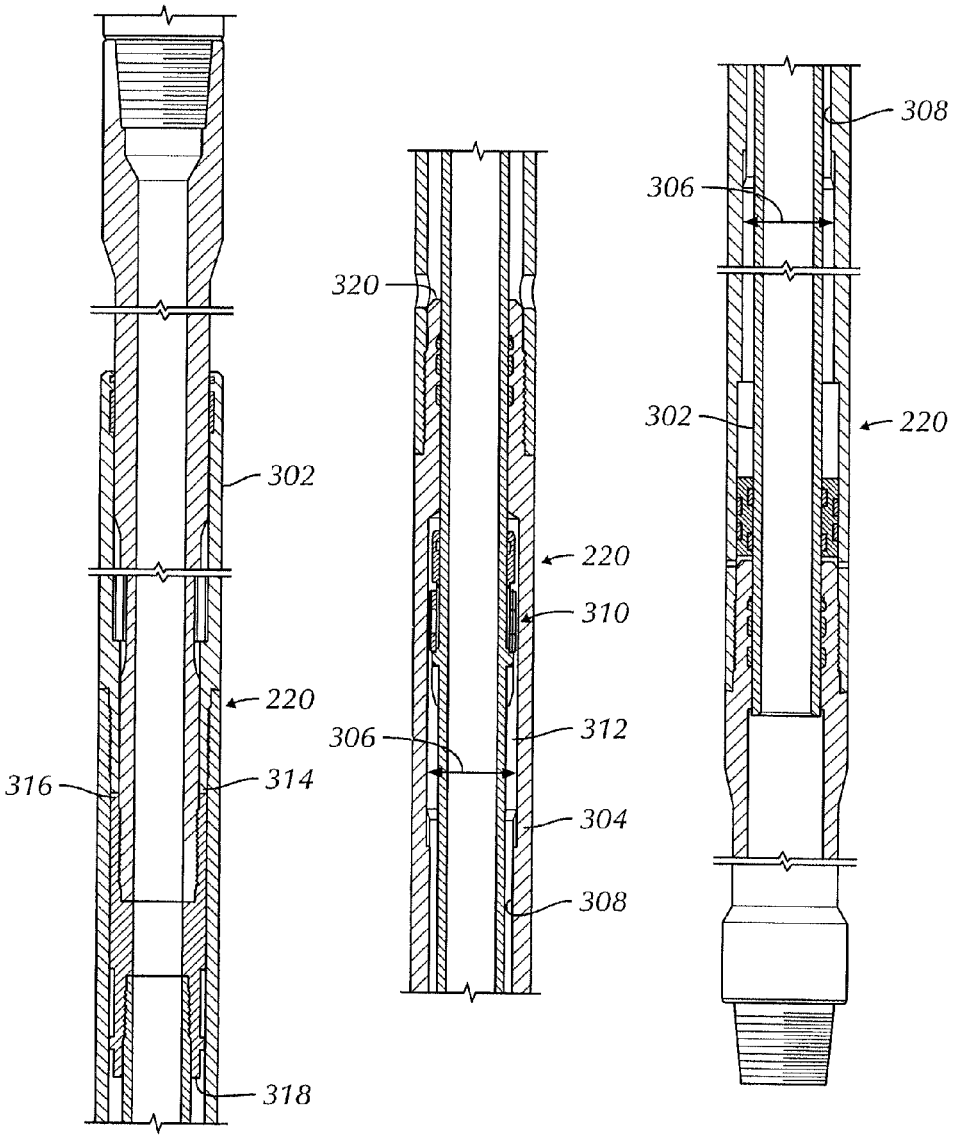
FIG. 2 (Prior Art)
FIG. 2 is a cross-sectional view of a prior art jarring tool.
Figure 3A:
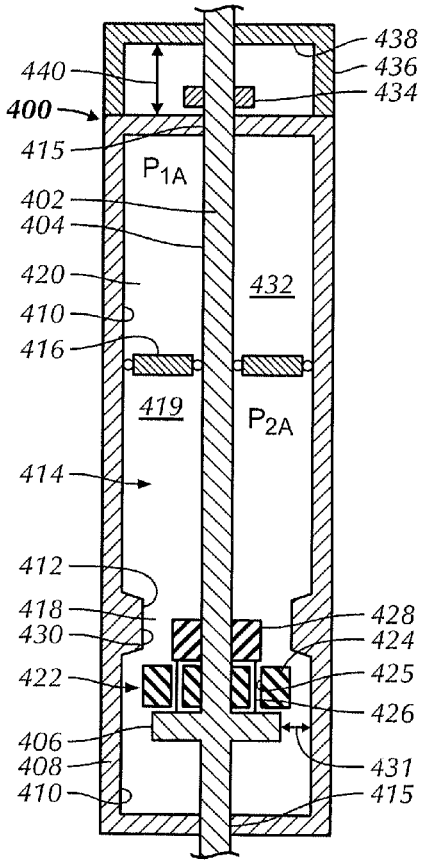
FIGS. 3A, 3B, 3C, and 3D are cross-sectional views of embodiments of a jarring tool in accordance with embodiments disclosed herein.

Referring to FIG. 3A, a cross-sectional view of an exemplary downhole jarring tool 400 in accordance with embodiments disclosed herein is shown. A mandrel 402 having a small diameter portion 404 and a large diameter portion 406, may be disposed inside of detent cylinder 408 having a large inner diameter portion 410 and a reduced inner diameter portion 412. Detent cylinder 408 may be sealed around mandrel 402, thereby forming an enclosure 414 in which fluid may be contained. An interface 415 between mandrel 402 and detent cylinder 408 may be provided with a sealing element such as, for example, an o-ring, or high pressure seal such that leaking of the fluid out of enclosure 414 may be prevented.

Additionally, still referring to FIG. 3A, a hammer 434 may be disposed around mandrel 402 inside of an upper chamber 436. Upper chamber 436 may be sealed off from storage chamber 420 by interface 415 between mandrel 402 and cylinder 408, thereby preventing fluid communication between upper chamber 436 and storage chamber 420. Upper chamber 436 may further include an inner top surface 438 which may act as an anvil when hammer 434 accelerates upward into contact with inner top surface 438 of upper chamber 436 as will be discussed herein. In certain embodiments, upper chamber 436 may have inner and outer diameters corresponding to inner and outer diameters of detent cylinder 408. A height 440 of upper chamber 436 may be designed to allow hammer 434 to move for a predetermined axial distance before contacting inner top surface 438 of upper chamber 436.

Figure 3B:
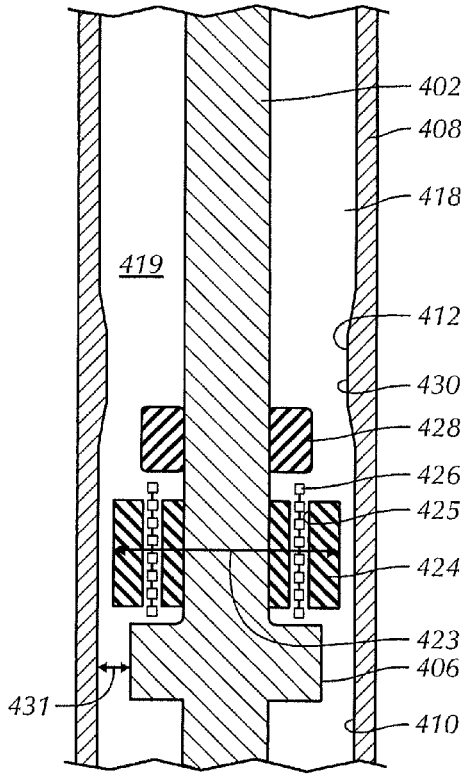
Figure 3C:
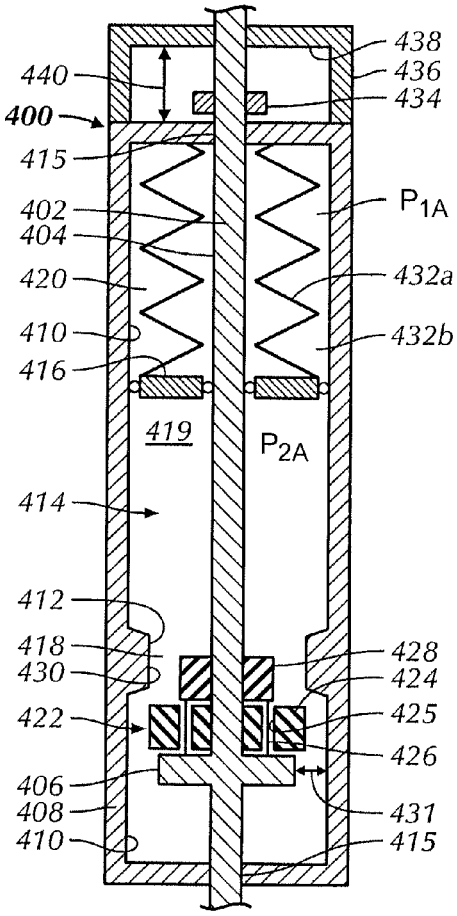
Figure 4:
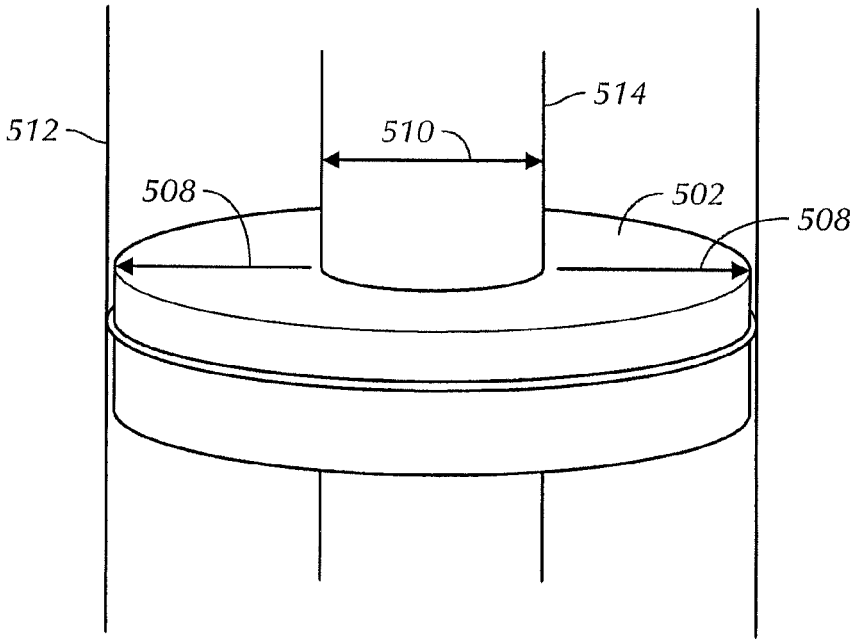
FIG. 4 is a perspective view of a floating piston.
Figure 5A:
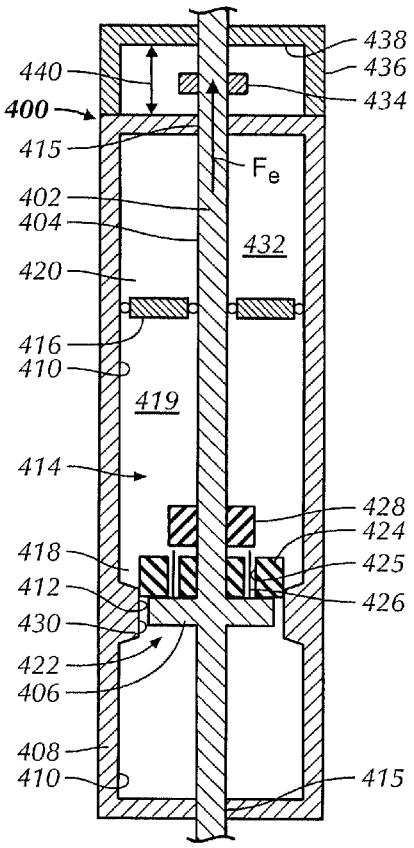
FIGS. 5A, 5B, 5C, and 5D are cross-sectional views of embodiments of a jarring tool in accordance with embodiments disclosed herein.
Figure 5B:
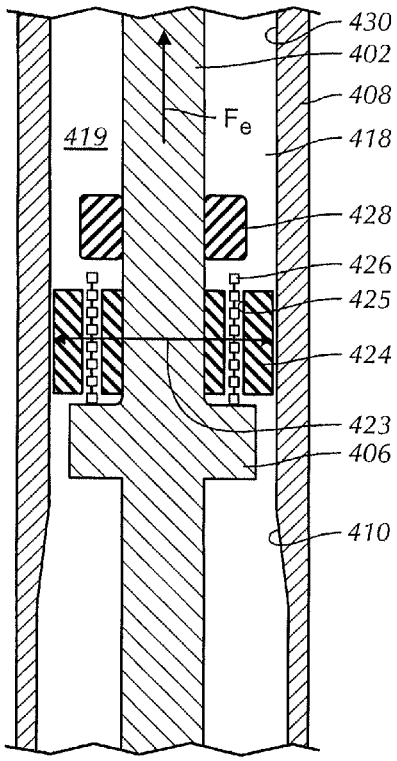
Figure 5C:
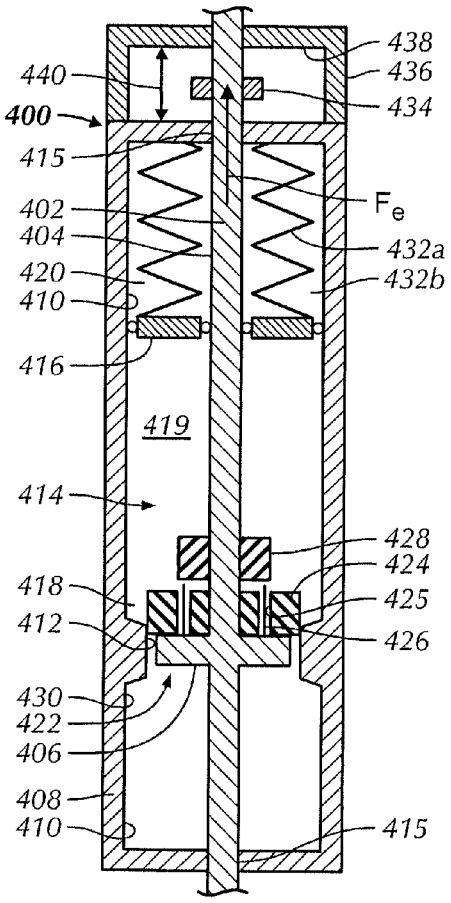
Figure 5D:
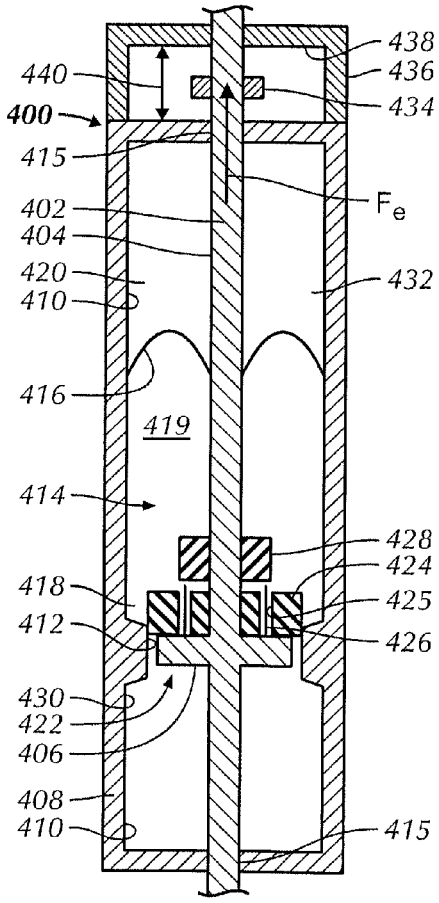
Figure 6A:
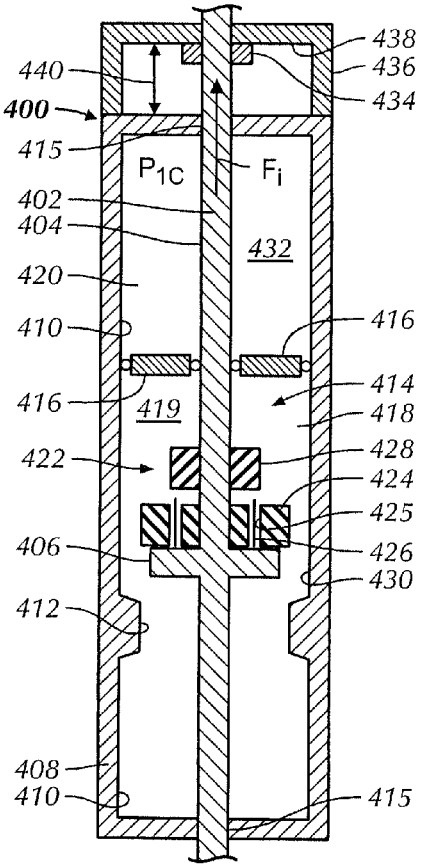
FIGS. 6A, 6B, 6C, and 6D are cross-sectional views of embodiments of a jarring tool in accordance with embodiments disclosed herein.
Figure 6B:
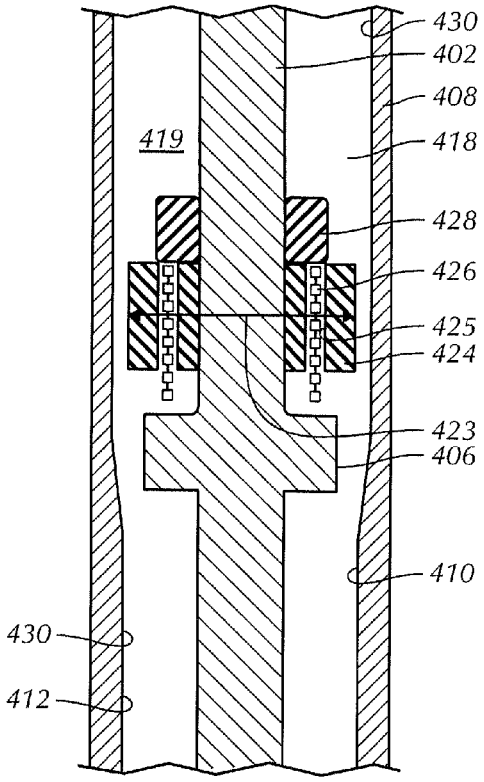
Figure 6C:
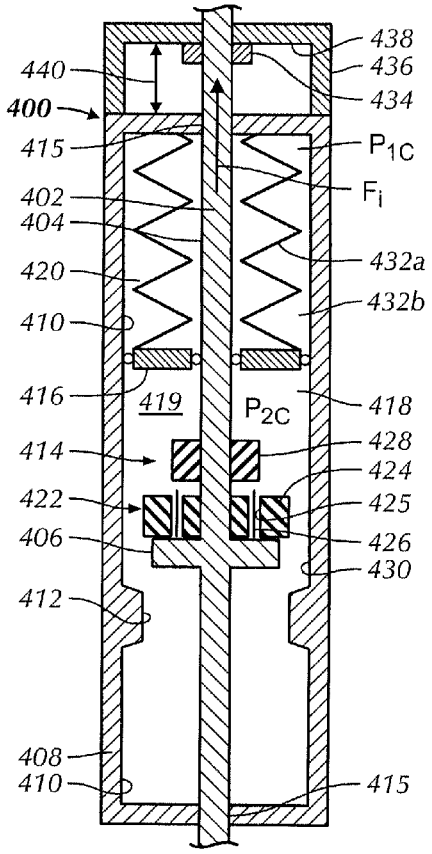
Figure 6D:
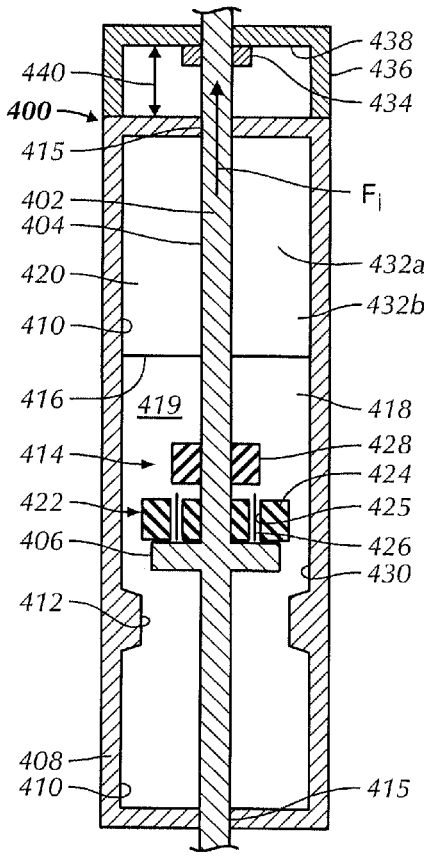

A divider 416 may be disposed inside of enclosure 414. As shown in FIGS. 3A and 3C, divider 416 may include a floating piston configured to seal between mandrel 402 and detent cylinder 408. Referring briefly to FIG. 4, a floating piston 502 in accordance with embodiments disclosed herein is shown. Floating piston 502 may be washer-shaped having an outer diameter 508 and an inner diameter 510. In certain embodiments, an outer seal 506 may be fitted around outer diameter 508 and an inner seal (not shown) may be fitted around inner diameter 510 such that floating piston 502 may be sealingly engaged between an outer housing 512 and an inner mandrel 514. Alternatively, those having ordinary skill in the art will appreciate that other sealing means known in the art may be used to seal floating piston 502 between outer housing 512, i.e., detent cylinder 408 (FIG. 3A), and inner mandrel 514. In certain embodiments, floating piston 502 may move axially with respect to outer housing 512 and inner mandrel 514 while maintaining a seal therebetween. For example, a pressure applied below floating piston 502 may push floating piston 502 upward along inner mandrel 514. One of ordinary skill in the art will appreciate that the amount of pressure required to move floating piston 502 may be determined by, for example, the geometry of floating piston 502, the geometry of outer seal 506 and inner seal (not shown), the number of the outer and inner seals, and/or the material of the outer and inner seals.

Figure 3D:
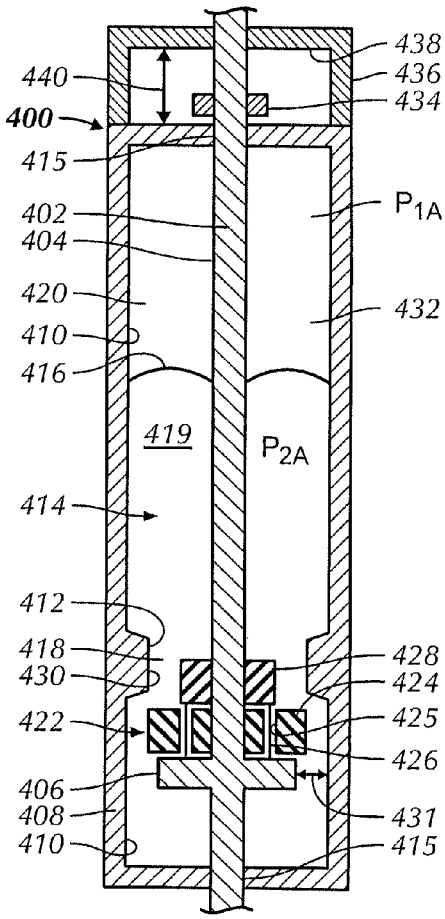

Alternatively, as shown in FIG. 3D, select embodiments of jarring tool 400 may include a divider 416 having a bladder or diaphragm. In such embodiments, the diaphragm may be fixed to an outer surface of mandrel 402 and to an inner surface of detent cylinder 408. In alternate embodiments, the bladder may be suspended in detent cylinder 408. The diaphragm may be formed from a material having high elasticity properties such that the diaphragm may be elastically stretched to store energy.

Referring to FIGS. 3A, 3C, and 3D together, divider 416 partitions enclosure 414 into a metering chamber 418 and a storage chamber 420. Metering chamber 418 may be filled with a metering fluid 419 such as, for example, hydraulic oil, while storage chamber 420 may house an energy storing component 432. In the embodiments shown in FIGS. 3A and 3D, energy storing component 432 may be a compressible fluid. In such embodiments, the compressible fluid may be compressible up to 75 percent by volume. In certain embodiments, the energy storing component may include at least one of a compressible mechanical device 432A and/or a compressible fluid 432B, as shown in FIG. 3C. In select embodiments, the compressible mechanical device may include a spring, and the compressible fluid may include, for example, nitrogen gas or silicone.

Referring to FIG. 3B, a cross-sectional view of a metering system 422 in accordance with embodiments of the present disclosure is shown having a detent ring 424, a metering pin 426, and a detent retaining ring 428. Detent ring 424 may be disposed around mandrel 402 axially adjacent large diameter portion 406 of mandrel 402. Detent ring 424 may have an outer diameter 423 equal to or slightly smaller than reduced inner diameter portion 412 of detent cylinder 408 such that detent ring 424 may fit sealingly into reduced inner diameter portion 412. An axial passage 425 may extend through detent ring 424 and a metering pin 426 may be disposed therein so that fluid flow therethrough may be restricted. In certain embodiments, metering pin 426 may be longer than passage 425 such that metering pin 426 extends beyond passage 425, as shown. Additionally, metering pin 426 may move relative to passage 425; however, movement of pin 426 may be limited by detent retaining ring 428 disposed proximate a first end of detent ring 424 and by large diameter portion 406 of mandrel 402 disposed proximate a second end of detent ring 424. Detent retaining ring 428 may be disposed around mandrel 402 in metering chamber 418, as shown. Detent retaining ring 428 may engage mandrel 402 adjacent detent ring 424 such that the axial movement of detent ring 424 and metering pin 426 may be restricted to the space between detent retaining ring 428 and large diameter portion 410 of mandrel 402. In certain embodiments, detent retaining ring 428 may threadedly engage mandrel 402. Those having ordinary skill in the art will appreciate that other means for coupling detent retaining ring 428 and mandrel 402 may be used such as, for example, set screws, welding, and/or adhesives.

Referring to FIGS. 3A, 3B, 3C, and 3D together, cross-sectional views of jarring tools 400 and metering system 422, respectively, are shown in an initial position. In an initial position, metering fluid 419 in metering chamber 418 may flow through a space between metering system 422 and an inner surface 430 of detent cylinder 408 at the large inner diameter portion 410. Additionally, metering fluid 419 may flow through passage 425 in detent ring 424. In the initial position, a first pressure, $P_{1A}$, of storage chamber 420 may be equal to a second pressure, $P_{2A}$, of metering chamber 418. Alternatively, in certain embodiments, first pressure $P_{1A}$ of storage chamber 420 may be greater than second pressure $P_{2A}$ of metering chamber 418. In such an embodiment, the pressure differential between first pressure $P_{1A}$ of storage chamber 420 and second pressure $P_{2A}$ of metering chamber 418 may be caused by pre-charging jarring tool 400. As used herein, a pre-charged jarring tool 400 is a jarring tool 400 having energy stored in energy storing component 432 prior to actuation of jarring tool 400. In certain embodiments, energy or pressure may be transmitted to energy storing component 432 prior to running jarring tool 400 downhole. In certain embodiments, the amount of pre-charge pressure stored in energy storing component 432 may be between approximately 100 psi and 10,000 psi. In select embodiments, the amount of pre-charge pressure stored in energy storing component 432 may be approximately 3000 psi. Divider 416 may prevent the pre-charge pressure differential from equalizing within jarring tool 400. For example, in an embodiment wherein divider 416 is a diaphragm, seals may be disposed between the diaphragm and mandrel 402 and between the diaphragm and detent cylinder 408. The seals may be chosen such that a desired pre-charge differential pressure may be maintained until jarring tool 400 is actuated.

Before jarring tool 400 creates and transmits an impact force to a stuck component, jarring tool 400 may be energized. Energizing jarring tool 400 may include transmitting energy to energy storing component 432. In embodiments where energy storing component 432 is pre-charged, additional energy may be transmitted to energy storing component 432 during energization of the jarring tool. In certain embodiments, energy may be transmitted to energy storing component 432 by moving metering system 422 from large diameter portion 410 of detent cylinder 408 into reduced inner diameter portion 412 of detent cylinder 408. To move metering system 422 into reduced inner diameter portion 412 of detent cylinder 408, operators pull mandrel 402 upward. Referring to FIGS. 5A, 5B, 5C, and 5D, jarring tools 400 are shown in an energizing configuration in accordance with embodiments disclosed herein. An energizing axial force $F_e$ may be applied to mandrel 402 such that a portion of mandrel 402 above the stuck downhole component stretches and metering system 422 is pulled into reduced inner diameter portion 412 of detent cylinder 408. In select embodiments, the stretching of mandrel 402 takes place within the elastic deformation region of the material that makes up mandrel 402. In such embodiments, energy is stored in the elastically deformed mandrel 402.

Energy may be transmitted to energy storing component 432 via a pressure differential across metering system 422 created by metering system 422 entering and sealingly engaging reduced inner diameter portion 412 of detent cylinder 408. Metering fluid 419 disposed in metering chamber 418 may resist movement of metering system 422 into reduced inner diameter portion 412 of detent cylinder 408. As such, metering fluid 419 may push detent ring 424 and metering pin 426 downward toward large diameter portion 406 of mandrel 402. Because large diameter portion 406 of mandrel 402 may be only slightly smaller than reduced inner diameter portion 412 of detent cylinder 408, metering fluid 419 may be prevented from flowing around or through metering system 422 or may be forced to flow through a small portion of passage 425 not blocked by metering pin 426. In certain embodiments, metering fluid 419 may be substantially incompressible, and as such, the pressure applied to metering fluid 419 by the movement of metering system 422 into reduced inner diameter portion 412 of detent cylinder 408 may be substantially transmitted to energy storing component 432, thereby energizing energy storing component 432. As metering system 422 is held within reduced inner diameter portion 412 of detent cylinder 408, metering fluid 419 may pass from an upper portion of metering chamber 418A, through passage 425 disposed in detent ring 424, to a lower portion of metering chamber 418B such that the differential pressure between an upper portion of metering chamber 418A and a lower portion of metering chamber 418B diminishes over time. Accordingly, it may be desirable to stretch mandrel 402 at a specific rate so as to move metering system 422 into reduced inner diameter portion 412 of detent cylinder 408 in a certain amount of time such that a certain amount of metering fluid 419 may flow around metering system 422 and a specific amount of pressure may be transmitted to energy storing component 432. Alternatively, as mandrel 402 is pulled upward, or stretched, an upper surface of large diameter portion 406 is moved into contact with a lower surface of detent ring 424, thereby blocking fluid flow through passage 425.

Referring to FIGS. 6A, 6B, 6C, and 6D, a cross-sectional view of jarring tool 400 and metering system 422, respectively, is shown after release of the energy built up jarring tool 400. To release the energy stored in jarring tool 400, mandrel 402 may be pulled through reduced inner diameter portion 412 of the detent cylinder 408 into upper large diameter portion 410 of detent cylinder 408. In such an embodiment, energy stored in energy storing components 432 may be released, thereby causing metering fluid 419 to accelerate around metering system 422 into lower large diameter portion 410 of detent cylinder 408. The downward acceleration of pressurized metering fluid 419 may accelerate metering system 422, mandrel 402, and hammer 434 in an upward direction until hammer 434 impacts an upper portion 438 of upper chamber 436. Additionally, the release of elastic strain energy stored in the drill pipe above the jarring tool 400 and in the connected mandrel 402 may accelerate metering system 422, mandrel 402, and hammer 434 in an upward direction. The acceleration and momentum of the upward-moving mandrel 402, metering system 422, and hammer 434 may then be transferred to a stuck component by the impact created by the collision of hammer 434 with an upper portion 438 of upper chamber 436.

Figure 7C:
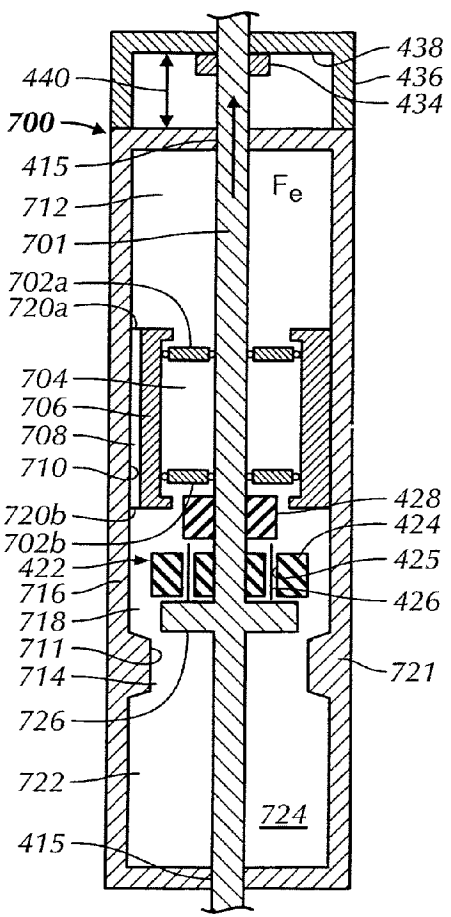
FIGS. 7A, 7B, and 7C are cross-sectional views of a jarring tool in accordance with embodiments disclosed herein.
Figure 7B:
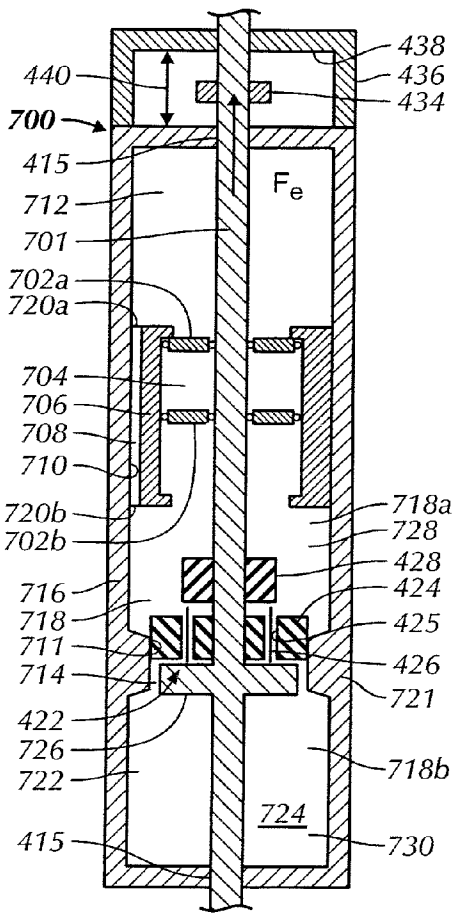
Figure 7A:
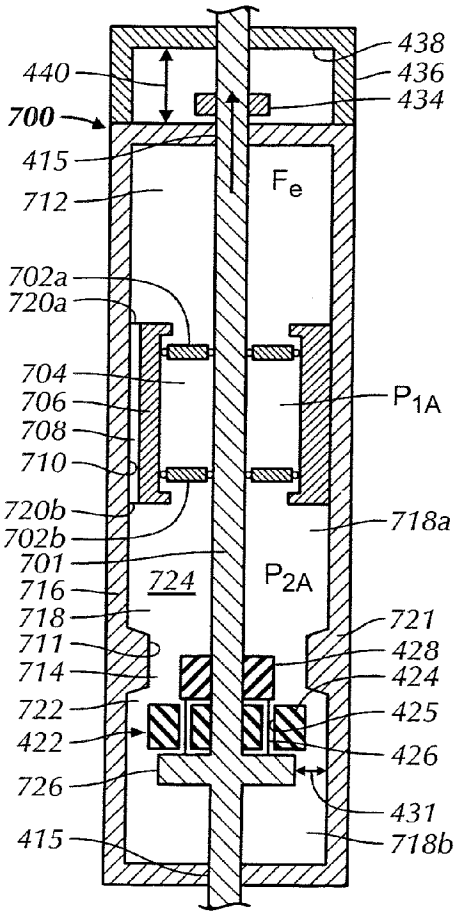

Referring to FIGS. 7A, 7B, and 7C, a downhole jarring tool 700 in accordance with embodiments disclosed herein is shown. Jarring tool 700 may include a set of floating pistons 702A, 702B separated by an energy storing component 704 housed within a piston retaining ring 706. In certain embodiments, energy storing component 704 may be a compressible fluid such as, for example, nitrogen gas or silicone. Alternatively, energy storing component 704 may include a compressible mechanical device (not shown) such as, for example, a spring. Floating pistons 702A, 702B may be sealingly disposed around a mandrel 701 and within piston retaining ring 706. Piston retaining ring 706 may include grooves 708 in an outer surface 710 thereof such that fluid communication may be provided between an upper fluid zone 712 and a lower fluid zone 714. In certain embodiments, outer surface 710 of piston retaining ring 706 may contact an inner surface 711 of detent cylinder 716 and, in select embodiments, piston retaining ring 706 may be fixed with respect to detent cylinder 716. Detent cylinder 716 may include an upper large diameter portion 718A, a lower large diameter portion 718B, and a reduced diameter portion 721 disposed between upper large diameter portion 718A and lower large diameter portion 718B. A metering system 422 having detent retaining ring 428, detent ring 424, metering pin 426, and passage 425 as discussed above with respect to FIGS. 4B, 5B, and 6B may be disposed around mandrel 701 in downhole jarring tool 700.

Referring to FIG. 7A, a downhole jarring tool 700 is shown in an initial position with metering system 422 disposed in lower large diameter portion 718B. Enclosure 722 may be filled with a fluid 724 and, in certain embodiments, fluid 724 may be substantially incompressible. In certain embodiments, an initial pressure $P_{1A}$ of energy storing component 704 may be greater than an initial pressure $P_{2A}$ of fluid 724 disposed in enclosure 722. In such an embodiment, energy storing component 704 may be said to be pre-charged. The amount of pre-charge pressure stored in energy storing component 704 may be between approximately 100 psi and 10000 psi. In select embodiments, the amount of pre-charge pressure stored in energy storing component 704 may be approximately 3000 psi.

Referring to FIG. 7B, a downhole jarring tool 700 is shown in an energized position. Energizing jarring tool 700 may include transmitting energy to energy storing component 704. In embodiments where energy storing component 704 is pre-charged, additional energy may be transmitted to energy storing component 704 during energization of the jarring tool 700. In certain embodiments, energy may be transmitted to energy storing component 704 by moving metering system 422 from lower large diameter portion 718B to reduced diameter portion 720. To move metering system 422 into reduced diameter portion 720 of detent cylinder 716, operators may pull mandrel 701 upward. As discussed above with respect to FIG. 5B, an energizing axial force $F_e$ may be applied to mandrel 701 such that a portion of mandrel 701 above the stuck downhole component stretches and metering system 422 is pulled into reduced diameter portion 721 of detent cylinder 716.

A large diameter portion 726 of mandrel 701 may be sized such that large diameter portion 726 of mandrel 701 sealingly engages reduced diameter portion 721. When large diameter portion 726 of mandrel 701 sealingly engages reduced diameter portion 721, a high pressure region 728 is created above metering system 422 and a lower pressure region 730 is created below metering system 422. In an embodiment wherein fluid 724 is substantially incompressible, the pressure built up in high pressure region 728 may press against floating pistons 702A, 702B such that floating pistons 702A, 702B are moved closer together, thereby compressing energy storing component 704 disposed therebetween. During energization of jarring tool 700, a small amount of fluid 724 disposed in high pressure region 728 may be pushed through upper port 720A, and/or through a groove 708, at a rate determined by the size of port 720A. Additionally, during energization of jarring tool 700, a low pressure region 730 created below metering system 422 may draw fluid into enclosure 722 through lower port 720B at a rate determined by the size of port 720B. In certain embodiments, an energized downhole jarring tool 700 may store energy in energy storing component 704, in a pressure differential between high pressure region 728 and lower pressure region 730, and/or in the elastic axial deformation of stretched mandrel 701.

Referring to FIG. 7C, energy stored within downhole jarring tool 700 may be released. In certain embodiments, metering system 422 may be pulled into upper large diameter portion 718A, such that fluid 724 disposed in high pressure region 728 may flow around metering system 422 into low pressure region 730, thereby creating a downward fluid impulse. When fluid from high pressure region 728 is allowed to communicate with fluid from low pressure region 730, the energy storing pressure differential is released. Accordingly, pressure no longer acts on pistons 702A, 702B to compress energy storing component 704. As such, energy stored within energy storing component 704 is also released, thereby accelerating fluid from high pressure region 728 to low pressure region 730 and increasing the amount of fluid impulse.

Simultaneously with the fluid impulse, elastic strain energy stored in the stretched drill pipe above jarring tool 400 and in the connected mandrel 701 may be released. Detent cylinder 716 may be anchored by a stuck downhole component and mandrel 701 may accelerate upward during recovery of the elastic deformation. Upward movement of mandrel 701, metering system 722, and hammer 434 may be abruptly stopped when hammer 434 collides with upper portion 438 of upper chamber 436, thereby exerting an upward impact force, $F_i$, on detent cylinder 716 and on the stuck component.

Because the amount of impact force that a jarring tool delivers directly depends on the amount of acceleration the mandrel achieves before impact, it may be desirable to accelerate the mandrel as much as possible. Advantageously, embodiments disclosed herein may provide a boost of energy to the mandrel to increase the acceleration thereof. Additionally, the present disclosure may provide additional acceleration to the mandrel without extending the length of the jarring tool and without requiring the use of an additional accelerator tool coupled to the jarring tool. Accordingly, embodiments disclosed herein may provide economic benefits by reducing the cost of a bottomhole assembly.

Additionally, when designing a BHA, overall length of the BHA is an important consideration and it may be desirable to keep the length of the BHA as short as possible. Additionally, it may be desirable to include as few tools as necessary in the BHA so that cost may be reduced. Advantageously, embodiments of the present disclosure may provide for a BHA having acceleration capabilities while having fewer tools and a shorter length than traditional BHAs having accelerator tools.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A downhole jarring tool comprising:

a mandrel having a small diameter portion and a large diameter portion;

a detent cylinder sealingly disposed around the mandrel, forming a sealed enclosure;

a divider disposed in the enclosure between the mandrel and the detent cylinder, wherein the divider partitions the enclosure into a storage chamber and a metering chamber; and a metering system disposed in the metering chamber below the divider.

2. The tool of claim 1, wherein the divider is at least one of a floating piston and a bladder.

3. The tool of claim 1, wherein the storage chamber comprises an energy storing component.

4. The tool of claim 3, wherein the energy storing component is configured to be pre-charged to between approximately 100 and 10,000 psi.

5. The tool of claim 4, wherein the energy storing component is configured to be pre-charged to approximately 3000 psi.

6. The tool of claim 3, wherein the energy storing component is at least one of a compressible fluid and a compressible mechanical device.

7. The tool of claim 6, wherein the compressible fluid is compressible up to 75 percent by volume.

8. The tool of claim 6, wherein the compressible fluid comprises at least one of nitrogen and silicone.

9. The tool of claim 6, wherein the compressible mechanical device comprises a spring.

10. The tool of claim 2, wherein the floating piston is sealed against the mandrel and the detent cylinder.

11. The tool of claim 1, wherein the metering system comprises:

a detent ring disposed adjacent the large diameter portion of the mandrel wherein the detent ring further comprises a metering passage disposed therethrough and a metering pin disposed in the metering passage; and a detent retaining ring disposed adjacent the detent ring, wherein the detent retaining ring engages the mandrel.

12. The tool of claim 1, wherein a first fluid disposed in the storage chamber is different from a second fluid disposed in the metering chamber.

13. A method of applying an impact force using a downhole jarring tool, the method comprising:

moving a mandrel with respect to a detent cylinder by applying an axial force;

positioning the mandrel such that a metering system disposed on the mandrel enters a reduced diameter portion of the detent cylinder from a large diameter portion of the detent cylinder;

transmitting energy to an energy storing component disposed inside the detent cylinder;

metering a fluid through the metering system; and accelerating the mandrel with respect to the detent cylinder, wherein the accelerating the mandrel comprises releasing energy stored in the energy storing component, thereby increasing a fluid impulse acting on the mandrel.

14. The method of claim 13, wherein transmitting energy to an energy storing component comprises compressing the energy storing component.

15. The method of claim 13, wherein transmitting energy to an energy storing component comprises:

moving the mandrel and the metering system upward; and moving a piston upward.

16. The method of claim 15, wherein moving a piston upward compresses at least one of a compressible fluid and a compressible mechanical device.

17. The method of claim 13, wherein metering the fluid through the metering system comprises allowing the fluid to flow from an upper portion of a metering chamber to a lower portion of the metering chamber through a passage disposed in a detent ring.

18. The method of claim 13, further comprising the step of pre-charging the energy storing component.

19. The method of claim 13, wherein the axial force is applied to the mandrel in an upward direction.

20. The method of claim 13, wherein the mandrel is accelerated in an axially upward direction with respect to the detent cylinder.

21. The method of claim 20, wherein the mandrel jars a component disposed therebelow.

22. The method of claim 13, further comprising:

returning the metering system to the large diameter portion of the detent cylinder; and allowing the fluid to flow around the metering system.

* * * * *